US011138990B1

(12) United States Patent
McElhone

(10) Patent No.: US 11,138,990 B1
(45) Date of Patent: Oct. 5, 2021

(54) VOICE ACTIVITY DETECTION

(71) Applicant: Bose Corporation, Framingham, MA (US)

(72) Inventor: Dale McElhone, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/862,126

(22) Filed: Apr. 29, 2020

(51) Int. Cl.

| | |
|---|---|
| ***G10L 25/78*** | (2013.01) |
| ***H04R 3/00*** | (2006.01) |
| ***G10L 21/0216*** | (2013.01) |
| ***H04R 1/10*** | (2006.01) |
| ***H04R 29/00*** | (2006.01) |
| ***G10K 11/178*** | (2006.01) |
| ***H04R 3/04*** | (2006.01) |

(52) U.S. Cl.
CPC ..... *G10L 25/78* (2013.01); *G10K 11/17823* (2018.01); *G10L 21/0216* (2013.01); *H04R 1/1083* (2013.01); *H04R 3/005* (2013.01); *H04R 3/04* (2013.01); *H04R 29/004* (2013.01); *G10K 2210/1081* (2013.01); *G10L 2021/02165* (2013.01); *H04R 2410/05* (2013.01)

(58) Field of Classification Search
CPC ..... G10L 25/78; G10L 21/0216; G10L 2021/02165; H04R 3/005; H04R 1/1083; H04R 29/004; H04R 29/007; H04R 3/04; H04R 2410/05; G10K 11/175; G10K 11/17823; G10K 2210/1081
See application file for complete search history.

(56) References Cited

U.S. PATENT DOCUMENTS

| | | | | |
|---|---|---|---|---|
| 9,313,572 | B2 | 4/2016 | Dusan et al. | |
| 9,949,017 | B2 | 4/2018 | Rule et al. | |
| 2010/0323652 | A1* | 12/2010 | Visser | H04R 3/005 455/232.1 |
| 2011/0288860 | A1* | 11/2011 | Schevciw | G10L 25/78 704/233 |

(Continued)

FOREIGN PATENT DOCUMENTS

| | | | |
|---|---|---|---|
| EP | 2242289 | | 10/2010 |
| KR | 101982812 | B1 * | 5/2019 |

OTHER PUBLICATIONS

International Search Report and the Written Opinion of the International Searching Authority, International Application No. PCT/US2021/028862, pp. 1-14, dated Aug. 12, 2021.

*Primary Examiner* — Yogeshkumar Patel
(74) *Attorney, Agent, or Firm* — Bond, Schoeneck & King, PLLC

(57) ABSTRACT

A headset that can detect the voice activity of a user includes an inner microphone generating an inner microphone signal; an outer microphone generating an outer microphone signal, wherein the inner microphone and outer microphone are positioned such that, when the headset is worn by a user, the inner microphone is disposed nearer to the user's head; and a voice-activity detector determining a sign of a phase difference between the inner microphone signal and the outer microphone signal and generating a voice activity detection signal representing a user's voice activity when the sign of the phase difference indicates that the outer microphone received an audio signal after the inner microphone received the audio signal.

20 Claims, 10 Drawing Sheets

(56) References Cited

U.S. PATENT DOCUMENTS

| | | | |
|---|---|---|---|
| 2012/0020485 | A1 | 1/2012 | Visser et al. |
| 2017/0193978 | A1 | 7/2017 | Goldman |
| 2018/0225082 | A1 | 8/2018 | An et al. |

* cited by examiner

VOICE ACTIVITY DETECTION

BACKGROUND

This disclosure is generally directed to voice activity detection. Various examples are directed to detecting a user's voice according to a phase difference between an inner microphone and an outer microphone of a headset.

SUMMARY

All examples and features mentioned below can be combined in any technically possible way.

According to an aspect, a headset includes an inner microphone generating an inner microphone signal; an outer microphone generating an outer microphone signal, wherein the inner microphone and outer microphone are positioned such that, when the headset is worn by a user, the inner microphone is disposed nearer to the user's head; and a voice-activity detector configured to determine a sign of a phase difference between the inner microphone signal and the outer microphone signal and to generate a voice activity detection signal representing a user's voice activity when the sign of the phase difference indicates that the outer microphone received an audio signal after the inner microphone received the audio signal.

In an example, the voice-activity detector is further configured to convert the inner microphone signal to a frequency-domain inner microphone signal comprising at least a first inner microphone signal phase at a first frequency and converts the outer microphone signal to a frequency-domain outer microphone signal comprising at least a first outer microphone signal phase at the first frequency, wherein the sign of the phase difference between the inner microphone signal and the outer microphone is determined according to a sign of a difference between the first inner microphone signal phase and the first outer microphone signal phase.

In an example, the frequency-domain inner microphone signal further comprises a second inner microphone signal phase at a second frequency and the frequency-domain outer microphone signal further comprises a second outer microphone signal phase at the second frequency, wherein the sign of the phase difference between the inner microphone signal and the outer microphone is further determined according to a sign of a difference between the second inner microphone signal phase and the second outer microphone signal phase.

In an example, the sign of the phase difference is a sign of a time-domain product of the inner microphone signal and the outer microphone signal.

In an example, the voice activity detection signal representing the user's voice activity is only generated when noise present in the outer microphone signal is below a threshold value.

In an example, the noise present in the outer microphone is determined according to a measure of similarity or linear relation between the inner microphone signal and outer microphone signal.

In an example, the measure of linear relation is a coherence.

In an example, the headset further includes an active noise canceler configured to produce a noise cancellation signal, the active noise canceler configured to perform at least one of discontinuing or minimizing a magnitude of the noise-cancellation signal and beginning production of or increasing a magnitude of a hear-through signal in response to the voice activity detection signal representing the user's voice activity being generated.

In an example, the headset further includes an audio equalizer configured to receive an audio signal input and produce an audio signal output, the audio equalizer discontinuing or minimizing an amplitude of the audio signal output in response to the voice activity detection signal representing the user's voice activity being generated.

In an example, the headset is one of: headphones, earbuds, hearings aids, or a mobile device.

According to another aspect, a method for detecting a user's voice activity, includes the steps of: providing a headset having an inner microphone generating an inner microphone signal and an outer microphone generating an outer microphone signal, wherein the inner microphone and outer microphone are positioned such that, when the headset is worn by a user, the inner microphone is disposed nearer to the user's head; determining a sign of a phase difference between the inner microphone signal and outer microphone signal; and generating a voice activity detection signal representing a user's voice activity when the sign of the phase difference indicates that the outer microphone received an audio signal after the inner microphone received the audio signal.

In an example, the method further includes the steps of: converting the inner microphone signal to a frequency-domain inner microphone signal comprising at least a first inner microphone signal phase at a first frequency; and converting the outer microphone signal to a frequency-domain outer microphone signal comprising at least a first outer microphone signal phase at the first frequency, wherein the sign of the phase difference between the inner microphone signal and the outer microphone is determined according to a sign of a difference between the first inner microphone signal phase and the first outer microphone signal phase.

In an example, the frequency-domain inner microphone signal further comprises a second inner microphone signal phase at a second frequency and the frequency-domain outer microphone signal further comprises a second outer microphone signal phase at the second frequency, wherein the sign of the phase difference between the inner microphone signal and the outer microphone is further determined according to a sign of a difference between the second inner microphone signal phase and the second outer microphone signal phase.

In an example, the sign of the phase difference is a sign of a time-domain product of the inner microphone signal and the outer microphone signal.

In an example, the voice activity detection signal representing the user's voice activity is only generated when noise present in the outer microphone signal is below a threshold value.

In an example, the noise present in the outer microphone is determined according to a measure of similarity or linear relation between the inner microphone signal and outer microphone signal.

In an example, the measure of linear relation is a coherence.

In an example, the method further includes the steps of: performing at least one of discontinuing or minimizing a magnitude of an active noise cancellation and beginning production of or increasing a magnitude of a hear-through signal in response to the voice activity detection signal representing the user's voice activity being generated.

In an example, the method further includes the steps of: discontinuing or minimizing production of an audio signal in response to the voice activity detection signal representing the user's voice activity being generated.

In an example, the inner microphone and outer microphone are disposed on one of: headphones, earbuds, hearings aids, or a mobile device.

The details of one or more implementations are set forth in the accompanying drawings and the description below. Other features, objects, and advantages will be apparent from the description and the drawings, and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

It is generally undesirable to produce an active noise-cancellation signal that cancels ambient noise (rather than, for example, the user's own voice) or to produce an audio output in a headset worn by a user speaking or otherwise engaged in a conversation. It is, accordingly, desirable to detect a user's voice and to discontinue any audio output from the headset that would distract or interfere with a user's conversation while the user's voice is detected. Various examples disclosed herein describe detecting a user's voice activity by comparing the phase of two microphones disposed on the headset.

Figure 1:
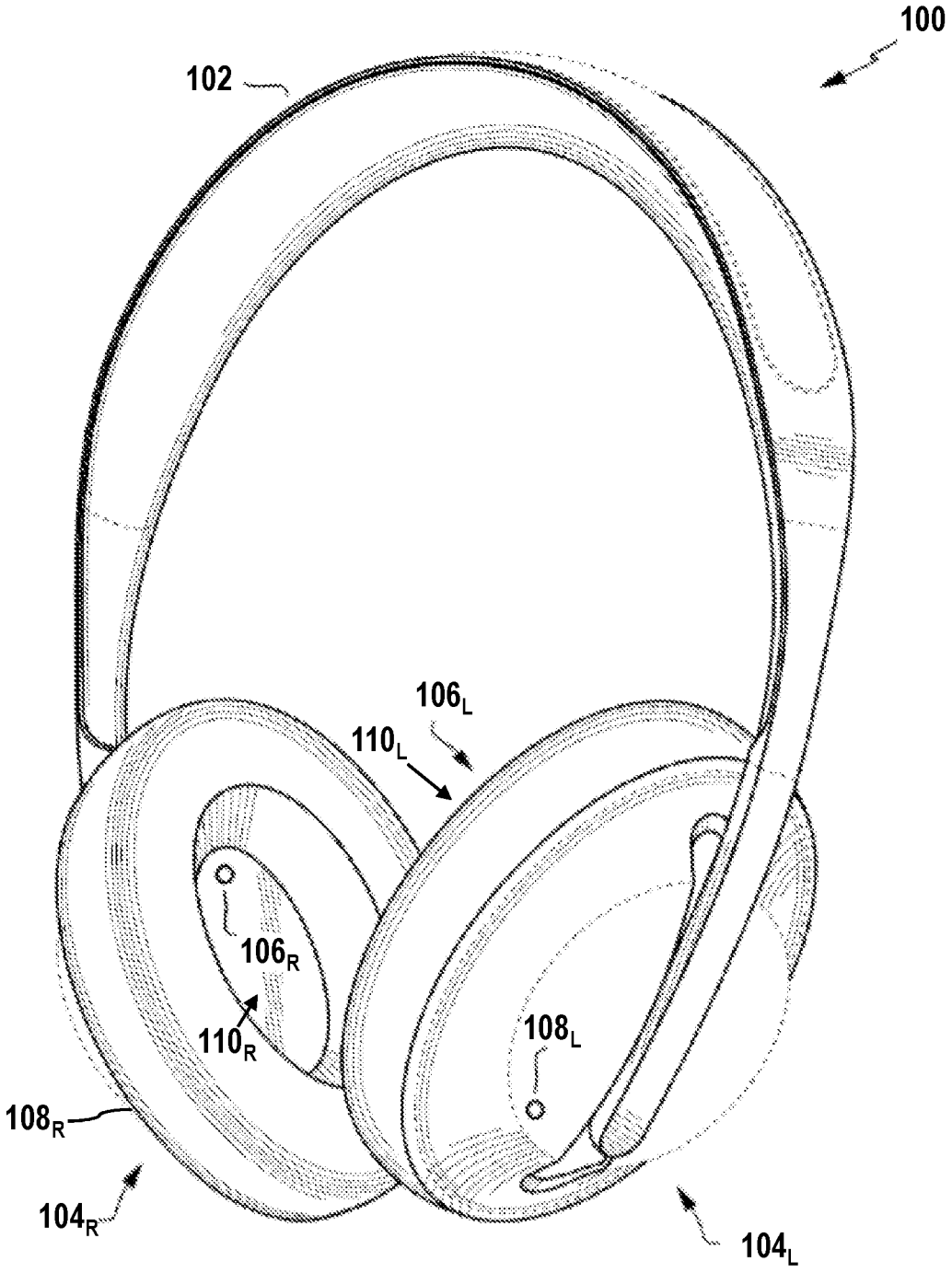
FIG. 1 depicts a perspective view of a headset having voice activity detection using an inner microphone and an outer microphone, according to an example.
Figure 2:
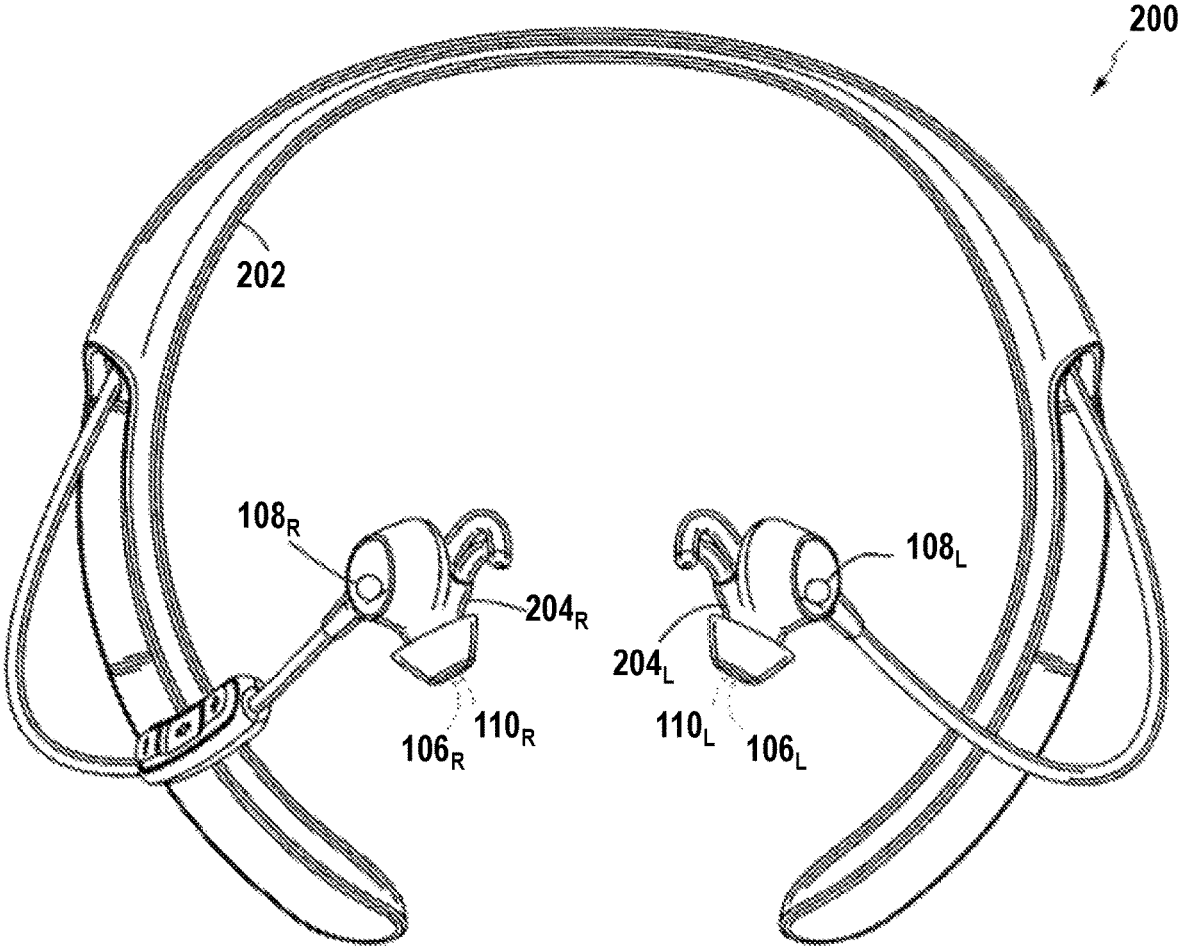
FIG. 2 depicts a perspective view of a headset having voice activity detection using an inner microphone and an outer microphone, according to an example.

There is shown in FIGS. 1 and 2 example headsets 100, 200 with voice activity detection. Turning first to FIG. 1, headset 100 is a pair of over-the-ear headphones having a headband 102 connected to a left earpiece $\mathbf{104}_L$ and a right earpiece $\mathbf{104}_R$. The left earpiece $\mathbf{104}_L$ includes an inner microphone $\mathbf{106}_L$ and an outer microphone $\mathbf{108}_L$. The left earpiece further includes a transducer $\mathbf{110}_L$ (i.e., a speaker) for transducing a noise-cancellation signal or any other input audio signal. Likewise, the right earpiece $\mathbf{104}_R$ includes inner microphone $\mathbf{106}_R$, outer microphone $\mathbf{108}_R$, and transducer $\mathbf{110}_R$. Headset 200 is a pair of in-ear headphones including a collar 202 from which a left earpiece $\mathbf{204}_L$ and a right earpiece $\mathbf{204}_R$ extend. Similar to headset 100, earpieces $\mathbf{204}_L$ and $\mathbf{204}_R$ respectively include an inner microphone $\mathbf{106}_L$, $\mathbf{106}_R$, an outer microphone $\mathbf{108}_L$, $\mathbf{108}_R$, and a transducer $\mathbf{110}_L$, $\mathbf{110}_8$.

In most examples, inner microphone 106 is located on an inner surface of the headset such as in an ear cup of the headset (e.g., as shown in FIG. 1) or positioned within the user's ear (e.g., as shown in FIG. 2), whereas the outer microphone 108 is located on an outer surface of the headset such as on the outside of the earpiece (e.g., as shown in FIGS. 1 and 2). However, it is only necessary that the inner microphone 106 be positioned nearer to the user's head than at least one corresponding outer microphone 108 such that the user's voice signal—as transduced by bone, tissue, the air, or other medium—reaches the inner microphone 106 before it reaches the corresponding outer microphone 108.

While a single inner microphone 106 and outer microphone 108 is shown disposed on each earpiece 104, 204, any number of inner microphones 106 and outer microphones 108 can be used. Further, the number of inner microphones 106 and outer microphones 108 need not be the same. For example, in some examples, each earpiece 104, 204 can include two inner microphones 106 and three outer microphones 108.

For the purposes of this disclosure, a headset is any device that is worn by a user or otherwise held against a user's head and that includes a transducer for playing an audio signal, such as a noise-cancellation signal or an audio signal. In various examples, a headset can include headphones, earbuds, hearings aids, or a mobile device.

Figure 3:
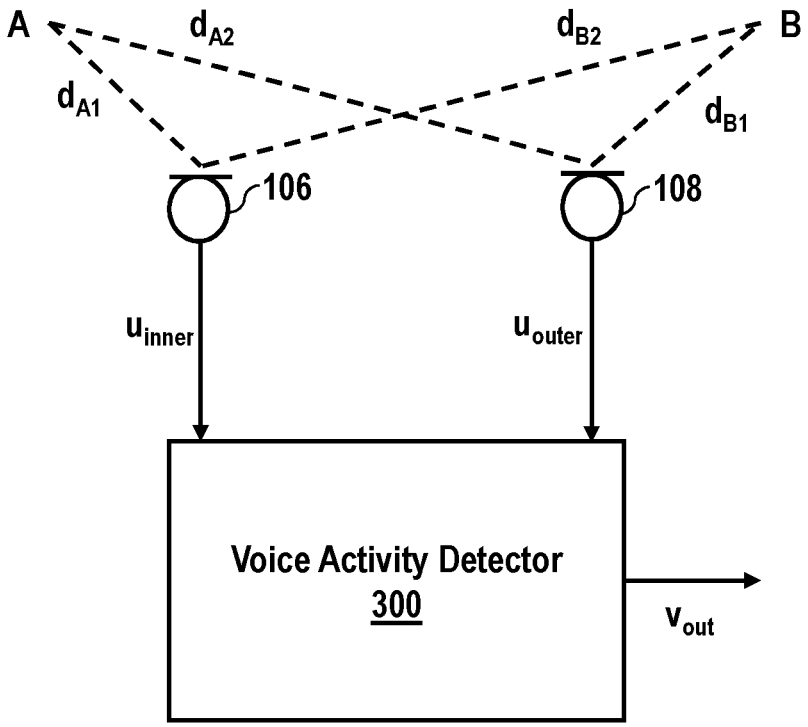
FIG. 3 depicts a block diagram of a voice activity detector, according to an example.

Each headset 100, 200 includes a voice activity detector 300, which is shown in the block diagram of FIG. 3. The voice activity detector 300 determines when a user, wearing or otherwise using the headset, is speaking according to a sign of a phase difference between the signals output by the inner microphone 106 and outer microphone 108. In various examples, voice activity detector 300 can be implemented in a controller, such as a microcontroller, including a processor and a non-transitory storage medium storing program code that, when executed by the processor, carries out the various functions of the voice activity detector 300 described in this disclosure. Alternatively, voice activity detector 300 can be implemented in hardware, such as an application-specific integrated circuit (ASIC) or field-programmable gate array (FPGA). In yet another example, the voice activity detector can be implemented as a combination of hardware, firmware, and/or software.

As shown in FIG. 3, voice-activity detector 300 receives an inner microphone signal $u_{inner}$ from inner microphone 106 and outer microphone signal $u_{outer}$ from outer microphone signal 108. Although FIG. 3 shows only one inner microphone signal $u_{inner}$ received from a single inner microphone 106 and only one outer microphone signal $u_{outer}$ from a single outer microphone 108, it will be understood in other examples that the voice-activity detector 300 can receive and use any number of inner microphone signals $u_{inner}$ and outer microphone signals $u_{outer}$.

As described above, voice-activity detector 300 determines a sign of a phase difference between the inner microphone signal $u_{inner}$ and the outer microphone signal $u_{outer}$ in order to detect the voice activity of a user. The phase difference between the inner microphone signal and the outer microphone signal indicates the directionality of an input audio signal. This is because the audio signal will be delayed as it travels from the audio source to one microphone and then the other. For example, if the audio signal originates at point A, nearer to the inner microphone 106 (e.g., from user voice-activity being transduced by the tissue and bone in the user's head), the audio signal will travel distance $d_{A1}$ to reach inner microphone 106 but distance $d_{A2}$, which is longer than distance $d_{A1}$, to reach outer microphone 108. Thus, the audio signal originating at point A will reach the inner microphone 106 first and outer microphone 108 second. Conversely, if the audio signal originates at point B, nearer to outer microphone 108 (e.g., from some audio source remote from the user) the audio signal will travel distance $d_{B1}$ to reach outer microphone 108 but distance $d_{B2}$, which is longer than distance $d_{B1}$, to reach inner microphone 106. Thus, the audio signal originating at point B will reach the outer microphone 108 first and inner microphone 106 second. The length of the delay between the audio signal reaching inner microphone 106 and outer microphone 108 will be determined by the distance between inner microphone 106 and outer microphone 108. From a signal perspective, this delay will manifest as a phase difference between the inner microphone signal $u_{inner}$ and outer microphone signal $u_{outer}$.

The relative delays will determine the sign of the phase difference between the inner microphone signal and the outer microphone signal. Thus, when an audio signal originates outside of the headset the phase difference will have one sign (e.g., positive); whereas, when an audio signal originates inside the headset the phase difference will the opposite sign (e.g., negative). In this way, the phase difference between the inner microphone signal $u_{inner}$ and the outer microphone signal $u_{outer}$ indicates a user's voice activity.

Whether the phase difference is positive or negative for an audio signal originating at a given point (either the user's voice activity or an outside source) depends on whether the phase difference is measured from the inner microphone signal $u_{inner}$ or the outer microphone signal $u_{outer}$. For example, a 90° phase difference as measured from the inner microphone signal $u_{inner}$ to the outer microphone signal $u_{outer}$ will be a −90° phase difference as measured from the outer microphone signal $u_{outer}$ to the inner microphone $u_{inner}$. Thus, for the purposes of this disclosure, the phase difference can be measured from either the inner microphone signal $u_{inner}$ to the outer microphone signal $u_{outer}$ or from the outer microphone signal $u_{outer}$ to the inner microphone signal $u_{inner}$. (A 90° phase difference is only provided as an example. It will be understood that the size of the phase difference will depend on the distance between the inner microphone 106 and outer microphone 108 and the frequency at which the phase difference is measured.)

Figure 4:
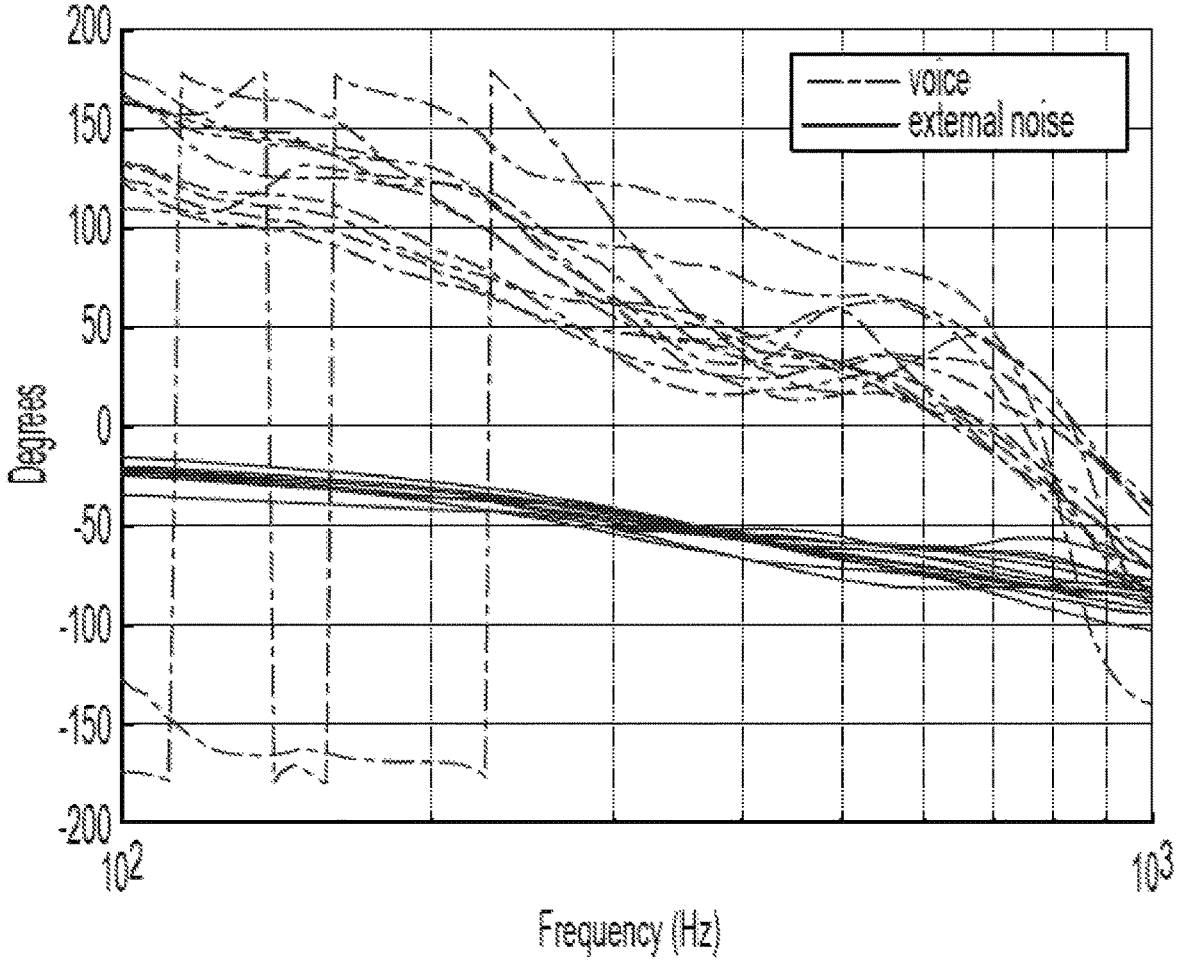
FIG. 4 depicts a plot of a phase difference between an inner microphone and an outer microphone across frequency.

The phase difference can be measured in any suitable manner. In a first example, the phase difference can be measured by converting the inner microphone signal and outer microphone signal to the frequency domain and comparing the phases of the microphone signals at at least one representative frequency. For example, the inner microphone signal and outer microphone signal can be processed with a discrete Fourier transform (DFT) yielding a plurality of frequency bins, each frequency bin including phase information of the associated microphone signal at a respective frequency. The phase information of one microphone signal (e.g., inner microphone signal $u_{inner}$) derived from the DFT at at least one representative frequency is then compared to the phase information of another microphone signal (e.g., outer microphone signal $u_{outer}$) at the same or different representative frequency. An example of the result of such a conversion is shown in FIG. 4, which is a plot of the phase difference between twelve inner microphone signals $u_{inner}$ and outer microphone signals $u_{outer}$ across a frequency band extending from 100 Hz to 1000 Hz when a user is speaking (labeled voice) and when a user is not speaking (labeled external noise). From approximately 250 Hz to 600 Hz the phase difference varies between approximately 180° phase difference to 0° phase difference; whereas, when the user is not speaking, the phase difference in the same frequency band varies from approximately −20° phase difference to −90° phase difference. In this example, a positive phase difference between the inner microphone signal $u_{inner}$ and the outer microphone signal $u_{outer}$ at any frequency in the range of 250 Hz to 600 Hz would accurately coincide with a user's voice activity.

While a DFT typically yields phase information at a plurality of frequency bins, in one example, the phases at only a single representative frequency can be determined and used to determine the phase difference. The single representative frequency can for example be the center frequency of the average bone/tissue-conducted human voice. For example, a typical female human voice generates acoustic excitation at an inner microphone from 200 Hz to 1000 Hz, thus the phase difference at the center frequency of 600 Hz can be used. Alternatively, a representative frequency that typically renders a phase difference sign that corresponds with user's speech can be determined empirically.

However, the phase difference at a single frequency is not necessarily suitable for determining a phase difference the sign of which will dependably coincide with the user's speech, as the speech quality and frequency range of a user's voice will vary from user to user. As shown in FIG. 3, the sign of the phase difference will vary across frequency, thus the sign of the phase difference used for voice activity detection can be determined from a number of different phase differences taken at a variety of different frequencies. Therefore, in an alternative example, the phases at multiple frequency bins can be used to determine the phase difference of the inner microphone signal $u_{inner}$ and outer microphone signal $u_{outer}$. Any number of methods can be used to determine the phase difference from the phases at multiple frequencies. For example, the phase difference can be determined based on the sign of a majority of phase differences at a plurality of frequencies. Thus, for five phase differences $p_1$-$p_5$, each taken at a respective representative frequency $f_1$-$f_5$, if three or more of the five are positive, the phase difference for the purpose of determining whether a user speaking can be determined to be positive. If, however, three or more of the five are negative it can be determined that the phase difference is negative. Alternatively, some threshold number of phase differences must be positive for it to be determined that the phase difference is positive. For example, if two of five phase differences are positive, or if one of five phase differences are positive, it can be determined that the phase difference is positive. In yet another example, the sign of the median phase difference of a plurality of phase differences can be used as the phase difference sign to determine whether a user is speaking. Where the phase differences of multiple frequency values are used to determine whether a user is speaking, the frequency bins used can be contiguous or, alternatively, the frequency bins used can be separated by one or more frequency bins.

While a DFT is discussed herein, any method for determining the phase of the signals at at least one representative frequency can be used. In alternative examples, a fast Fourier transform (FFT) or discrete cosine transform (DCT) can be used.

In an alternative example, rather than converting the inner microphone signal $u_{inner}$ and the outer microphone signal $u_{outer}$ to the frequency domain, the phase difference between inner microphone signal $u_{inner}$ and outer microphone signal $u_{outer}$ can be determined in the time domain. For example, the sign of the phase difference between the inner microphone signal $u_{inner}$ and the outer microphone signal $u_{outer}$ can be determined by the time-domain product of the inner microphone signal $u_{inner}$ and the outer microphone signal $u_{outer}$ (e.g., the product of one or more samples of the inner microphone signal $u_{inner}$ and the outer microphone signal $u_{outer}$). If the product is positive, it can be determined that the phase difference between the inner microphone signal $u_{inner}$ and outer microphone signal $u_{outer}$ is positive. However, if the product is negative, it can be determined that the phase difference between the inner microphone signal $u_{inner}$ and outer microphone signal $u_{outer}$ is negative. One or both of these time domain signals may be filtered, e.g., bandpass filtered, to improve the phase estimate within a certain frequency range of interest.

Where there are multiple inner microphones 106 and/or multiple outer microphones 108, phase differences can be found between any number of combinations of inner microphones 106 and outer microphones 108. For example, if a headset includes three inner microphones 106 and three outer microphones 108, the phase difference between each of the three inner microphones can be found for each of the three outer microphones yielding nine separate phase differences. In this manner, it is not necessary for the number of inner microphones 106 and outer microphones 108 to be symmetric. Indeed, the phase difference can be found between one inner microphone and three outer microphones, yielding three phase differences. Alternatively, the phase difference of each inner microphone can be found for only one outer microphone. The only qualification is that the inner microphone 106 be positioned relative to the outer microphone 108 to receive a user's voice before the outer microphone 108.

Voice-activity detector 300 generates a voice-activity detection signal when the voice activity is detected. Voice-activity detection signal can be a binary signal having a first value (e.g., 1) when voice activity is detected and a second value (e.g., 0) when voice activity is not detected. In an alternative example, these values can be reversed (e.g., 1 when voice activity is detected and 0 when voice activity is not detected). Furthermore, the voice-activity detection signal can be a signal internal to a controller and can be stored and referenced by other subsystems or modules within the headset for the purposes of dictating other functions. For example, an active noise-cancellation system of the headset can be turned ON/OFF according to the value of the voice-activity detection signal.

The reliability of the phase difference between the inner microphone and the outer microphone will suffer in the presence of diffuse noise. For example, in a noisy environment, the content of the inner microphone signal $u_{inner}$ may be unrelated to the content of the outer microphone signal $u_{outer}$ and thus any measured phase difference is not indicative of an audio signal delay. The voice-activity detector 300, accordingly, can be configured to only output a voice-activity detection signal indicative of a user's voice-activity when the noise is below a threshold. The noise can be detected by measuring a relation or similarity between the inner microphone signal $u_{inner}$ and outer microphone signal $u_{outer}$. For example, voice-activity detector 300 can measure a coherence (which is a measure of linear relation) between the inner microphone signal $u_{inner}$ and outer microphone signal $u_{outer}$. If the coherence exceeds a threshold (e.g., 0.5), it can be determined that the measured phase difference will detect a delay between the inner microphone signal $u_{inner}$ and the outer microphone signal $u_{outer}$. Alternatively, any measure of relation or similarity can be used. For example, rather than coherence, a correlation can be used to determine the similarity of the inner microphone signal $u_{inner}$ and outer microphone signal $u_{inner}$.

Figure 5:
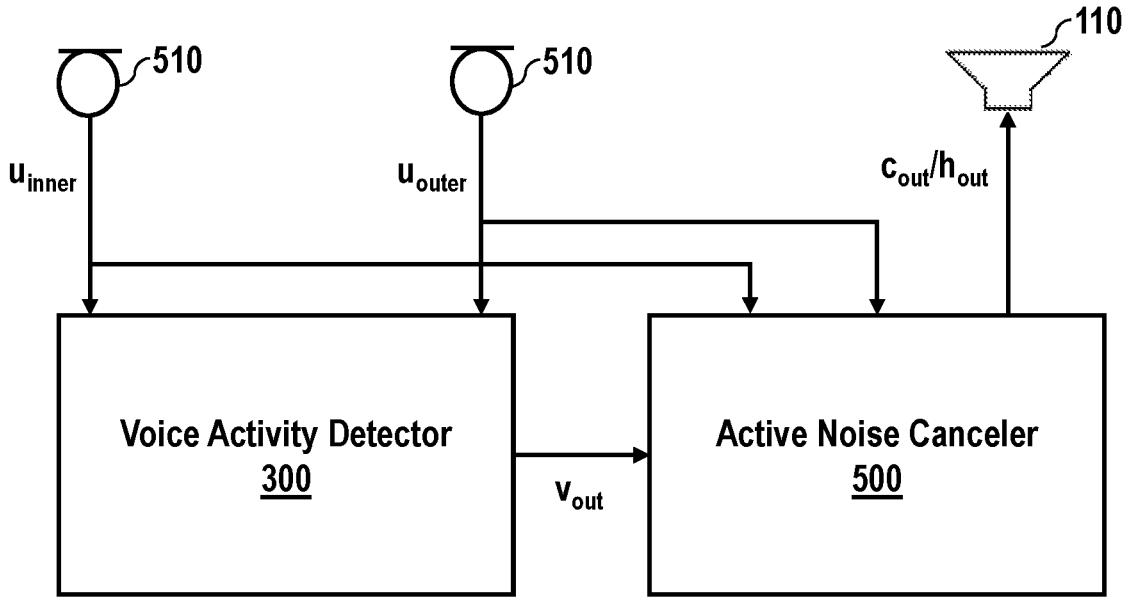
FIG. 5 depicts a block diagram of a voice activity detector and active noise canceler, according to an example.

While inner microphone 106 and outer microphone 108 can be dedicated voice-activity detection microphones, in alternative examples, the inner microphones and outer microphones can be used for a dual purpose, such as inputs for an active noise canceler 500, as shown in FIG. 5. In operation, the active noise canceler 500 produces a noise-cancellation signal $c_{out}$ from the transducer 110 that is out of phase to and destructively interferes with the ambient noise, eliminating or reducing the noise that the user perceives. Such active noise cancelers are generally known and any suitable active noise canceler can be used in the headset. Inner microphone signal $u_{inner}$ and outer microphone signal $u_{outer}$ can be used as feedback and feedforward signals, respectively. Alternatively, separate microphone signals can be used for the purpose of noise-cancellation.

Similarly, active noise canceler 500 can provide a hear-through signal $h_{out}$. For the purposes of this disclosure, hear-through varies the active noise cancellation parameters of a headset so that the user can hear some or all of the ambient sounds in the environment. The goal of active hear-through is to let the user hear the environment as if they were not wearing the headset at all, and further, to control its volume level. In one example, the hear-through signal $h_{out}$ is provided by using one or more feed-forward microphones (e.g., outer microphone 108) to detect the ambient sound and adjusting the ANR filters for at least the feed-forward noise cancellation loop to allow a controlled amount of the ambient sound to pass through the earpiece with different cancellation than would otherwise be applied, i.e., in normal noise cancelling operation. One such active hear through method is described in U.S. Pat. No. 9,949,017 titled "Controlling ambient sound volume," herein incorporated by reference in its entirety, although any suitable hear-through method can be used.

The noise cancellation signal $c_{out}$ can be produced in a manner that does not interfere with a user engaged in a conversation. Generally, a user will not want noise-cancellation that attenuates ambient noise while speaking or otherwise engaged in a conversation. Thus, active noise canceler 500 can receive the voice-activity detection signal $v_{out}$ and determine whether to produce a noise-cancellation signal $c_{out}$ as a result. For example, once active noise canceler 500 receives a voice activity detection signal $v_{out}$ that indicates the user is speaking (e.g., $v_{out}$ has a value of 1) the production of the noise-cancellation signal $c_{out}$ can be discontinued or its magnitude reduced while the user is speaking or for some period of time after the user finishes speaking. (Generally, a user that is speaking is engaged in a conversation and is thus listening for a response and is likely to speak again soon.) Likewise, in another example, or in the same example, production of the hear-through signal $h_{out}$ can be started or its magnitude increased while a user is speaking or for some period of time after the user finishes speaking. One or both measures—decreasing the magnitude of or discontinuing the noise-cancellation signal $c_{out}$ or starting or increasing the magnitude of the hear-through signal $h_{out}$—can be employed to allow a user to more naturally engage in conversation without interference of active noise cancellation.

Figure 6:
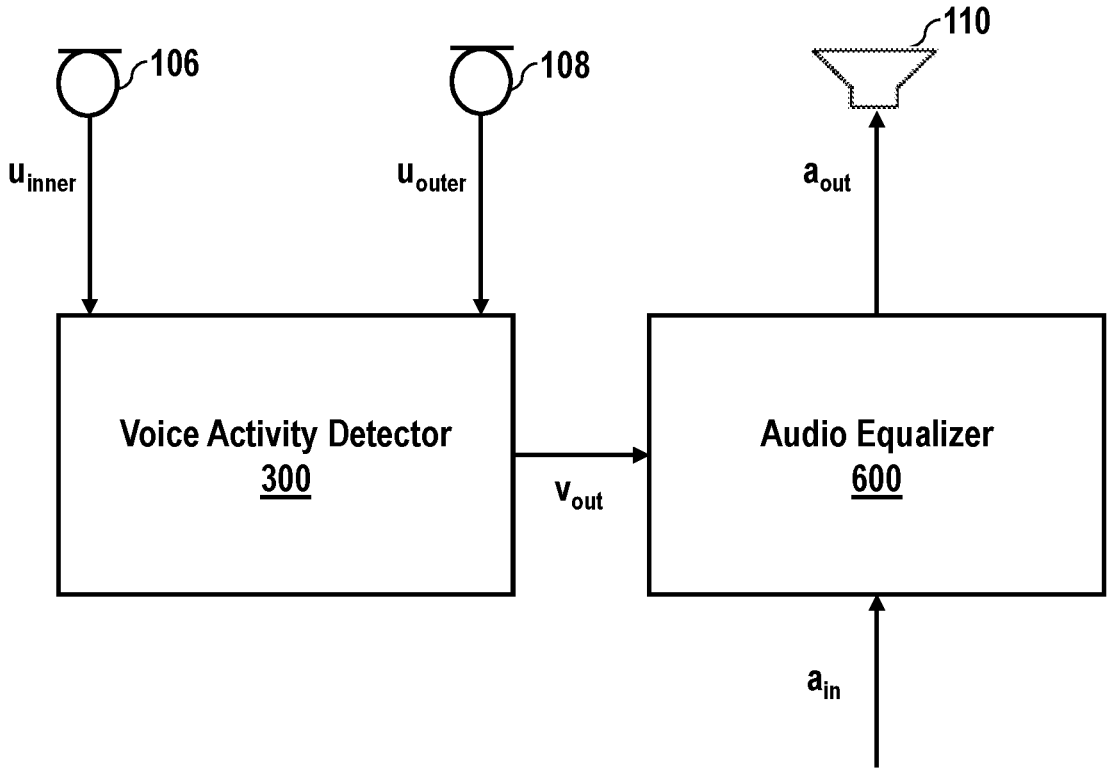
FIG. 6 depicts a block diagram of a voice activity detector and an audio equalizer, according to an example.

Similarly, as shown in FIG. 6, an input audio signal such $a_{in}$ such as music playback can be paused. Like a noise-cancellation signal, it is not necessarily desirable to play music while a user is speaking or engaged in a conversation. Audio equalizer 600 receives an input audio signal $a_{in}$ either from an outside source, such as a mobile device or computer, or from local storage and produces an output $a_{out}$ to transducer 110. Generally, audio equalizer comprises one or more filters for conditioning $a_{in}$ and producing $a_{out}$ which is transduced into an audio signal by transducer 110. Audio equalizer 600 can further be configured to route signals to multiple transducers 110. In one example, audio equalizer 600 receives $v_{out}$ from voice-activity detector 300 and, in response, pauses or minimizes the magnitude of output audio signal $a_{out}$. For example, once voice-activity detection signal $v_{out}$ indicates that a user's voice activity is detected, audio equalizer can fade out the output audio signal $a_{out}$ until the user has finished speaking. Furthermore, audio equalizer can institute a delay after the user has finished speaking before fading back in the audio signal $a_{out}$.

The active noise canceler 500 and audio equalizer 600 of FIGS. 5 and 6, respectively, can each be implemented in a controller, such as a microcontroller, including a processor and a non-transitory storage medium storing program code that, when executed by the processor, carries out the various functions of the active noise canceler 500 and audio equalizer 600 described in this disclosure. Active noise canceler 500 and audio equalizer 600 can be implemented on the same controller or separate controllers. Similarly, one or both of active noise canceler 500 and audio equalizer 600 can be implemented on the same controller as voice activity detector 300. Alternatively, active noise canceler 500 and audio equalizer 600 be implemented in hardware, such as an application-specific integrated circuit (ASIC) or field-programmable gate array (FPGA). In yet another example, active noise canceler 500 and audio equalizer 600 can each be implemented as a combination of hardware, firmware, and/or software.

FIG. 700 shows a flowchart of a method 700 for detecting a user's voice activity performed by a headset such as headset 100 or headset 200. The headset of method 700 includes at least one inner microphone and at least one outer microphone, positioned such that, when the headset is worn by a user, the inner microphone is positioned nearer to the user's head than the outer microphone such that it receives a user's voice signal before the outer microphone. The steps of method 700 can be implemented, for example, as steps defined in program code stored on a non-transitory storage medium and executed by a processor of a controller disposed within the headset. Alternatively, the method steps can be carried out by the headset using a combination of hardware, firmware, and/or software.

At step 702 the inner microphone signal and outer microphone signal are received. While only two microphone signals are described here, any number of inner microphone signals and outer microphone signals can be received. Indeed, be understood that the steps of method 700 can be repeated for any combinations of multiple inner microphone signals and outer microphone signals.

At step 704, a sign of a phase difference between the inner microphone and outer microphone is determined. This step can require first converting the inner microphone signal and the outer microphone signal to the frequency domain, such as with a DFT, and finding a phase difference between the phases of the inner microphone signal and outer microphone signal at at least one representative frequency. Alternatively, the phase difference can be determined according to multiple phase differences calculated at multiple frequencies. In yet another example, the phase difference can be found in the time domain. For example, the sign of the phase difference can be determined by finding the sign of the product of one or more samples of the inner microphone signal and outer microphone signal. One or both of these signals may be filtered, e.g., bandpass filtered, to improve phase estimate within a certain frequency range of interest.

At step 706 the sign of the phase difference determined at step 704 is used to detect voice activity of the user. Step 706 is thus represented as a decision block, which asks whether the sign of the phase difference between the inner microphone and outer microphone indicates that the inner microphone receives an audio signal first (the sign can be positive or negative, depending on how the phase difference is calculated). If the sign indicates that the inner microphone received the audio signal before the outer microphone, a voice-activity detection signal indicating a user's voice activity is generated (at step 708); if the sign indicates that the outer microphone received the audio signal before the inner microphone, a voice-activity signal that does not indicate a user's voice activity is generated (step 710). Because this is a binary determination, if the sign of the phase difference does not indicate that the inner microphone received the audio signal first, then it indicates that the outer microphone received the audio signal first. This decision block could thus be restated to ask whether the phase difference indicates that the outer microphone received the audio signal first, in which case the YES and NO branches would be reversed.

As mentioned above, at step 708, a voice-activity detection signal indicating a user's voice activity is generated. Conversely, at step 710, a voice-activity detection signal indicating no user's voice activity is generated. The voice-activity detection signal can thus be a binary signal having a value for voice detection (e.g., 1) and a value for no voice detection (e.g., 0). Because a signal with a value of 0 is often a signal having a value of 0 V, it should be understood that, for the purposes of this disclosure, the absence of a signal can be considered a generated signal if the absence is interpreted by another system or subsystem as indicating either voice detection or no voice detection.

Figure 7A:
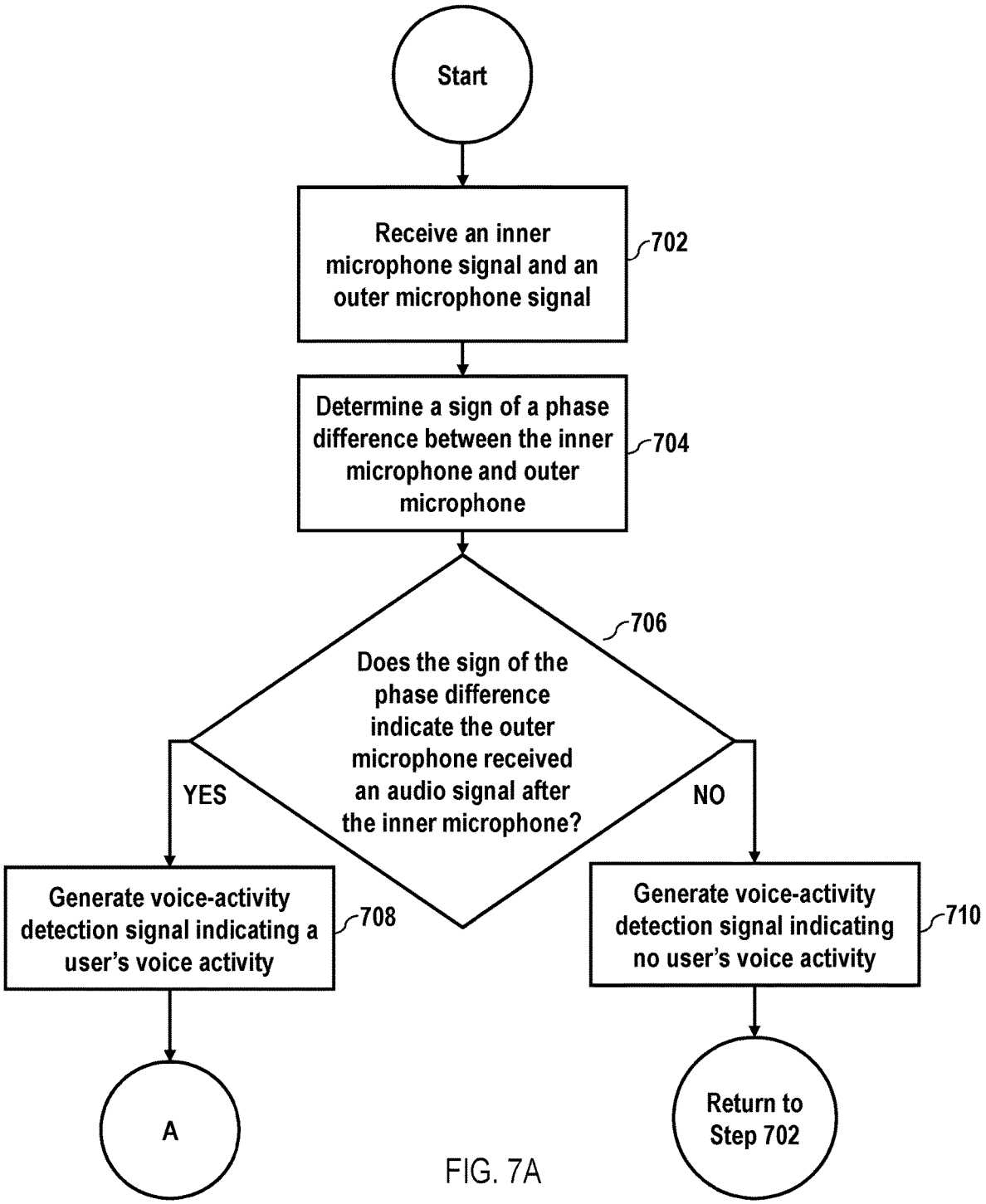
FIG. 7A depicts a flowchart for voice activity detection using an inner microphone and an outer microphone, according to an example.
Figure 7B:
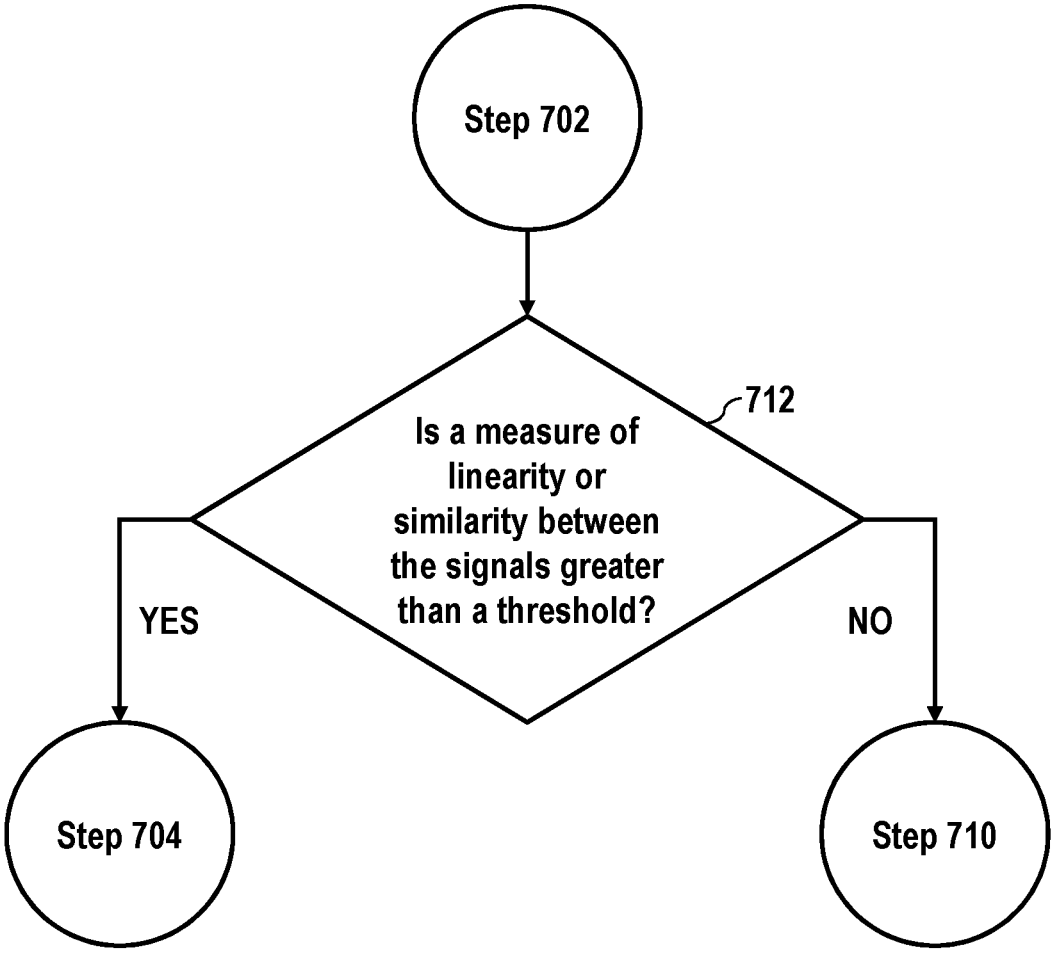
FIG. 7B depicts a flowchart for voice activity detection using an inner microphone and an outer microphone, according to an example.

FIG. 7B depicts an alternative example of method 700, in which step 712 occurs between steps 702 and 704. Step 712 is represented as a decision block, which asks whether a measure of linear relation or similarity between the inner microphone signal and the outer microphone signal exceeds a threshold. Such a measure of linear relation can be, for example, a coherence, while a measure of similarity can be, for example, a correlation. The purpose of this step is to determine whether diffuse noise, which lacks the directionality sufficient to find a meaningful phase difference between the inner microphone signal and outer microphone signal, dominates the inner microphone signal and outer microphone signal. In an alternative example, any method of detecting ambient noise can be used. If the measure of linear relation or similarity exceeds the threshold, the method proceeds to step 704, where the phase difference is found as described above. Alternatively, if the measure of linear relation does not exceed the threshold, the step proceeds to step 710, in which a voice-activity detection signal indicative of no user voice activity is generated. In alternative examples, this step can be performed elsewhere in method 700, such as after the phase difference is found.

Figure 7C:
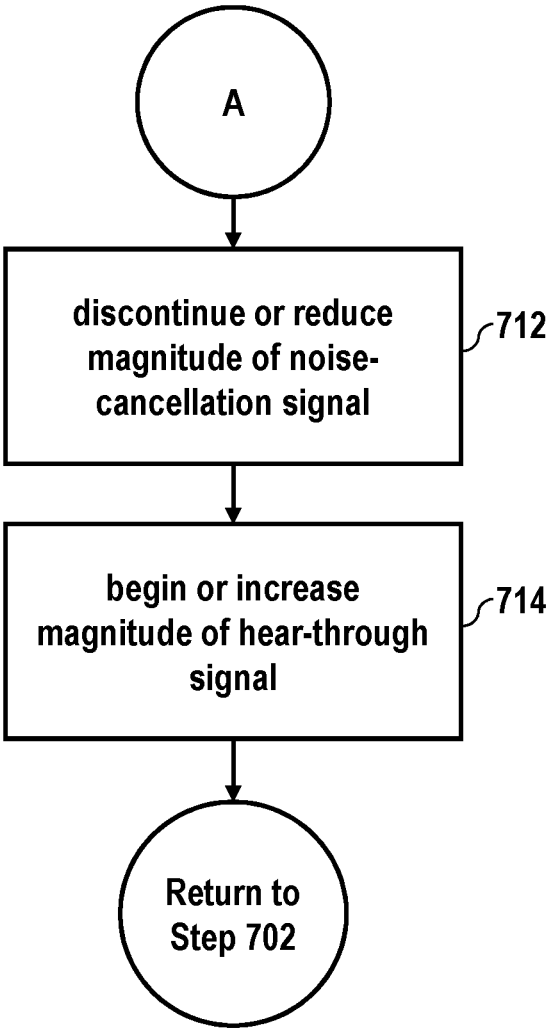
FIG. 7C depicts a flowchart for voice activity detection using an inner microphone and an outer microphone, according to an example.
Figure 7D:
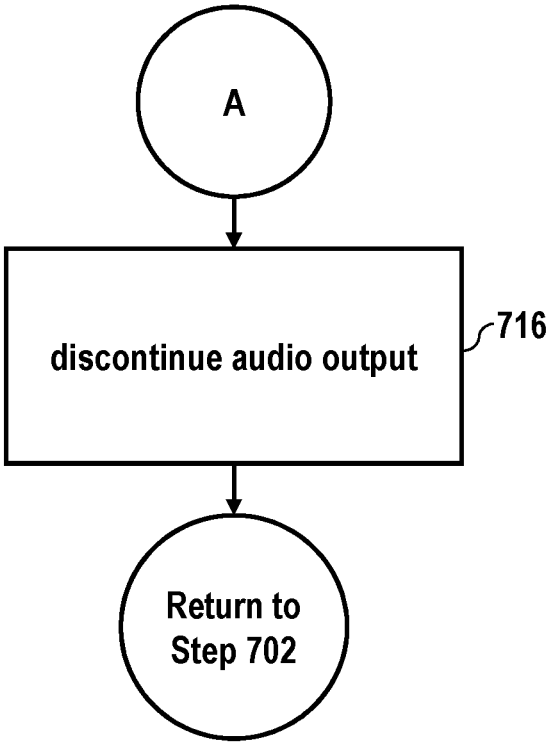
FIG. 7D depicts a flowchart for voice activity detection using an inner microphone and an outer microphone, according to an example.

FIGS. 7C and 7D depict some optional actions following the detection of a user's voice activity. In FIG. 7C a noise cancellation signal, at step 712, output from the headset transducers to cancel or otherwise minimize noise perceived by the user, is discontinued or its magnitude reduced. The noise-cancellation signal can be discontinued or reduced until the user's voice is no longer detected or for some predetermined time thereafter. In an alternative or in addition to step 712, production of a hear-through signal, output from the headset transducers to permit a user to hear some ambient noise, is begun or the magnitude of such a signal is increased at step 714. Thus, following the detection of the user's voice, the hear-through signal can be produced or its magnitude increased until the user's voice is no longer detected or for some predetermined time thereafter. Similarly, FIG. 7D depicts, at step 716, discontinuing an audio signal output from the headset transducers, such as music received from a mobile device or computer. For example, following the detection of a user's voice the audio output signal can be faded out. The audio output signal can be discontinued until the user's voice is no longer detected or for some predetermined time thereafter. While FIGS. 7C and 7D are presented as alternatives, in other examples, any combination of steps 712, 714, and 716 can be implemented.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A headset comprising:

an inner microphone generating an inner microphone signal;

an outer microphone generating an outer microphone signal, wherein the inner microphone and outer microphone are positioned such that, when the headset is worn by a user, the inner microphone is disposed nearer to the user's head; and a voice-activity detector configured to determine a sign of a phase difference between the inner microphone signal and the outer microphone signal and to generate a voice activity detection signal representing a user's voice activity when the sign of the phase difference indicates that the outer microphone received an audio signal after the inner microphone received the audio signal.

2. The headset of claim 1, wherein the voice-activity detector is further configured to convert the inner microphone signal to a frequency-domain inner microphone signal comprising at least a first inner microphone signal phase at a first frequency and converts the outer microphone signal to a frequency-domain outer microphone signal comprising at least a first outer microphone signal phase at the first frequency, wherein the sign of the phase difference between the inner microphone signal and the outer microphone is determined according to a sign of a difference between the first inner microphone signal phase and the first outer microphone signal phase.

3. The headset of claim 2, wherein the frequency-domain inner microphone signal further comprises a second inner microphone signal phase at a second frequency and the frequency-domain outer microphone signal further comprises a second outer microphone signal phase at the second frequency, wherein the sign of the phase difference between the inner microphone signal and the outer microphone is further determined according to a sign of a difference between the second inner microphone signal phase and the second outer microphone signal phase.

4. The headset of claim 1, wherein the sign of the phase difference is a sign of a time-domain product of the inner microphone signal and the outer microphone signal.

5. The headset of claim 1, wherein the voice activity detection signal representing the user's voice activity is only generated when noise present in the outer microphone signal is below a threshold value.

6. The headset of claim 5, wherein the noise present in the outer microphone is determined according to a measure of similarity or linear relation between the inner microphone signal and outer microphone signal.

7. The headset of claim 6, wherein the measure of linear relation is a coherence.

8. The headset of claim 1, further comprising an active noise canceler configured to produce a noise cancellation signal, the active noise canceler configured to perform at least one of discontinuing or minimizing a magnitude of the noise-cancellation signal and beginning production of or increasing a magnitude of a hear-through signal in response to the voice activity detection signal representing the user's voice activity being generated.

9. The headset of claim 1, further comprising an audio equalizer configured to receive an audio signal input and produce an audio signal output, the audio equalizer discontinuing or minimizing an amplitude of the audio signal output in response to the voice activity detection signal representing the user's voice activity being generated.

10. The headset of claim 1, wherein the headset is one of: headphones, earbuds, hearings aids, or a mobile device.

11. A method for detecting a user's voice activity, comprising the steps of:

providing a headset having an inner microphone generating an inner microphone signal and an outer microphone generating an outer microphone signal, wherein the inner microphone and outer microphone are positioned such that, when the headset is worn by a user, the inner microphone is disposed nearer to the user's head;

determining a sign of a phase difference between the inner microphone signal and outer microphone signal; and generating a voice activity detection signal representing a user's voice activity when the sign of the phase difference indicates that the outer microphone received an audio signal after the inner microphone received the audio signal.

12. The method of claim 11, further comprising the steps of:

converting the inner microphone signal to a frequency-domain inner microphone signal comprising at least a first inner microphone signal phase at a first frequency; and converting the outer microphone signal to a frequency-domain outer microphone signal comprising at least a first outer microphone signal phase at the first frequency, wherein the sign of the phase difference between the inner microphone signal and the outer microphone is determined according to a sign of a difference between the first inner microphone signal phase and the first outer microphone signal phase.

13. The method of claim 12, wherein the frequency-domain inner microphone signal further comprises a second inner microphone signal phase at a second frequency and the frequency-domain outer microphone signal further comprises a second outer microphone signal phase at the second frequency, wherein the sign of the phase difference between the inner microphone signal and the outer microphone is further determined according to a sign of a difference between the second inner microphone signal phase and the second outer microphone signal phase.

14. The method of claim 11, wherein the sign of the phase difference is a sign of a time-domain product of the inner microphone signal and the outer microphone signal.

15. The method of claim 11, wherein the voice activity detection signal representing the user's voice activity is only generated when noise present in the outer microphone signal is below a threshold value.

16. The method of claim 15, wherein the noise present in the outer microphone is determined according to a measure of similarity or linear relation between the inner microphone signal and outer microphone signal.

17. The method of claim 16, wherein the measure of linear relation is a coherence.

18. The method of claim 11, further comprising the step of: performing at least one of discontinuing or minimizing a magnitude of an active noise cancellation and beginning production of or increasing a magnitude of a hear-through signal in response to the voice activity detection signal representing the user's voice activity being generated.

19. The method of claim 11, further comprising the step of: discontinuing or minimizing production of an audio signal in response to the voice activity detection signal representing the user's voice activity being generated.

20. The method of claim 11, wherein the inner microphone and outer microphone are disposed on one of: headphones, earbuds, hearings aids, or a mobile device.

* * * * *